United States Patent [19]

Bridges

[11] Patent Number: 4,937,900

[45] Date of Patent: Jul. 3, 1990

[54] ELECTRIC SOFA BED

[76] Inventor: Bobby L. Bridges, Rt. 2, Box 3492, Nicholson, Ga. 30565

[21] Appl. No.: 337,747

[22] Filed: Apr. 13, 1989

[51] Int. Cl.[5] ..... A47C 17/04; A47C 17/17

[52] U.S. Cl. ..... 5/37 R; 5/47; 297/330; 297/342

[58] Field of Search ..... 5/37 R, 30, 47, 44 R, 5/37 B, 37 C; 297/330, 342

[56] References Cited

U.S. PATENT DOCUMENTS

| | | | |
|---|---|---|---|
| 169,099 | 11/1875 | Goodwin | 5/18 B |
| 1,126,894 | 2/1915 | Sisbower | 5/18 R |
| 2,718,256 | 9/1955 | Carte . | |
| 3,458,877 | 8/1969 | Edwards | 5/47 |
| 3,634,893 | 1/1972 | Hern et al. | 5/37 R |
| 3,913,152 | 10/1975 | Quakenbush | 5/37 R |
| 4,001,901 | 1/1977 | Quakenbush | 5/37 R |
| 4,037,872 | 7/1977 | Quakenbush | 5/13 |
| 4,104,747 | 8/1978 | Bell et al. | 5/37 R |
| 4,131,960 | 1/1979 | Quakenbush | 5/37 R |
| 4,321,716 | 3/1982 | Shrock | 5/37 R |
| 4,512,048 | 4/1985 | Isham et al. | 5/37 R |
| 4,543,675 | 10/1985 | Shrock | 5/37 R |
| 4,563,784 | 1/1986 | Shrock et al. | 5/37 R |
| 4,569,093 | 2/1986 | Hermann | 5/37 R |
| 4,731,888 | 3/1988 | Bridges | 5/37 R |

*Primary Examiner*—Alexander Grosz

*Attorney, Agent, or Firm*—Fleit, Jacobson, Cohn, Price, Holman & Stern

[57] ABSTRACT

A base frame is provided as well as a forward seat support, a rear seat back support and a kick panel support. First linkage structure is connected between the base frame and the seat back support for guided movement thereof between a raised generally upright position and a lowered generally horizontal position, second linkage structure is connected between the base frame and the seat support for guided movement thereof between a first generally horizontal position and a second slightly rearwardly and downwardly inclined position and third likage structure is operatively connected between the base frame and the kick panel support for movement thereof between a lowered upstanding position disposed foward of the main frame and a raised horizontal position. In addition, first connecting structures connected between the first and second linkage structure and second connecting structure is connected between the second and third linkage structure in a manner such that the rear seat back support, seat support and kick panel support all are disposed in their horizontal positions at one set of limit positions thereof and are disposed in their upright, slightly rearwardly and downwardly inclined and upstanding positions, respectively, thereof in the other set of limit positions of movement thereof, there being provided reversable electric motor driven screw jack assembly structure operatively connected between the main frame and one of the connecting links for simultaneous movement of the sections between the limit positions of movement thereof.

13 Claims, 3 Drawing Sheets

FIG. 3
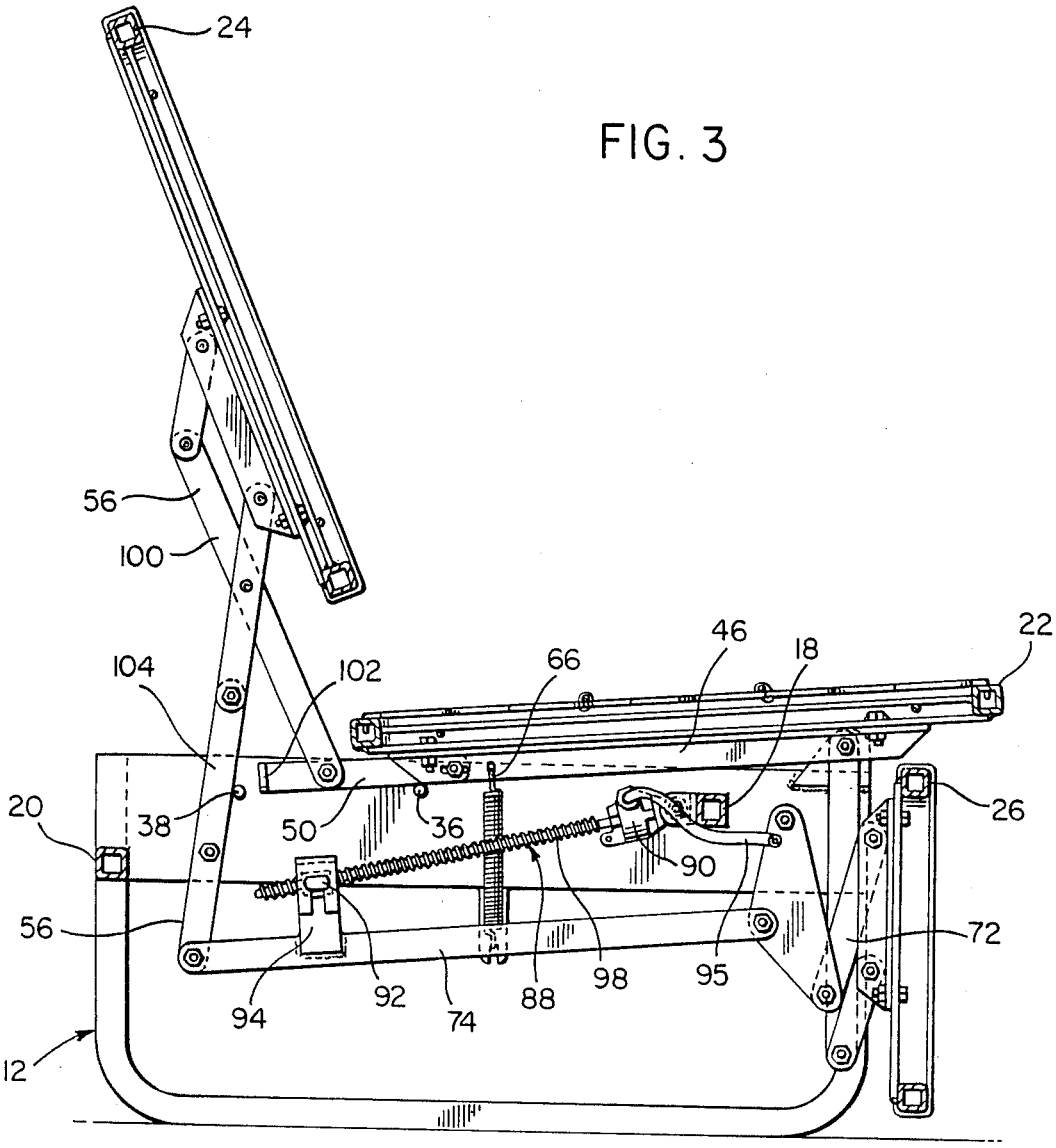
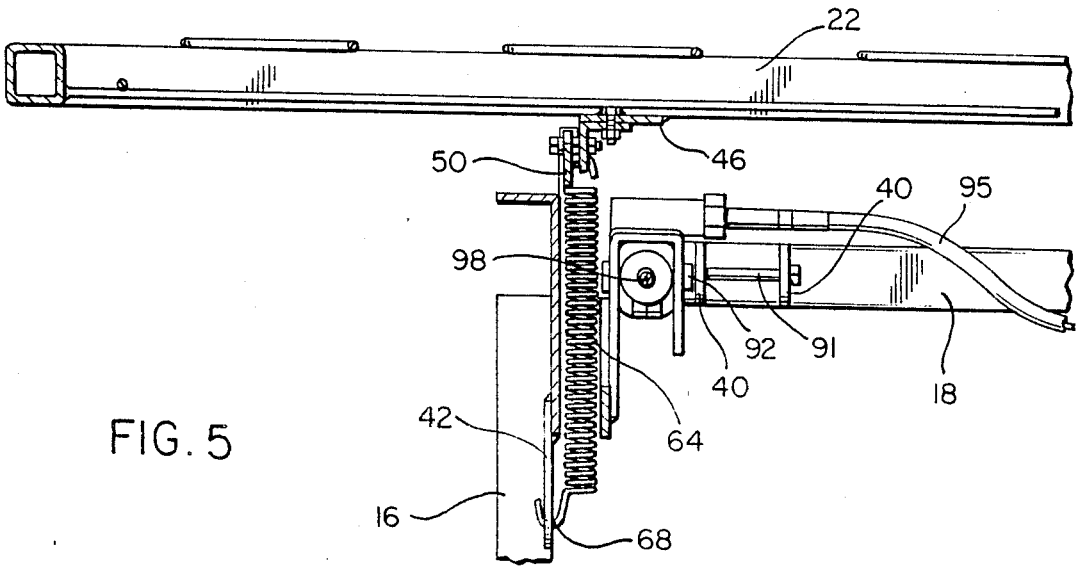
FIG. 5

ELECTRIC SOFA BED

BACKGROUND OF THE INVENTION

1. Field of the Invention

This invention relates to a convertible sofa bed assembly for use in a vehicle and is constructed in a manner such that the assembly may be readily converted between a sofa defining arrangement and a bed defining arrangement, there being provided reversable motor driven drive structure by which the conversion between a sofa defining arrangement and a bed defining arrangement may be effected.

2. Description of Related Art

Various different forms of convertible seat bed assemblies and sofa bed assemblies heretofore have been provided such as those disclosed in U.S. Pat. Nos. 169,099, 1,126,894, 2,718,256, 3,634,893, 3,931,152, 4,001,901, 4,037,872, 4,104,704, 4,131,960, 4,321,716, 4,512,048, 4,543,675, 4,563,784, 4,569,093 and 4,731,888. However, these previously known forms of convertible seat bed and sofa bed assemblies do not include the structural and operational features of the instant invention which coact to provide a convertible sofa bed that may be readily shifted between a sofa defining position and a bed defining position and wherein reversable electric motor drive structure is provided for effecting the conversion of the assembly between a sofa defining arrangement and a bed defining arrangement and further wherein linkage structure operatively connects the drive structure to the various shiftable components of the assembly in a manner such that relatively low powered drive structure may be utilized.

SUMMARY OF THE INVENTION

The convertible sofa bed assembly of the instant invention has been specifically designed for use in a vehicle such as a van and may be converted between a sofa defining arrangement and a bed defining arrangement. Conventionally, when electric motor drive structure is provided for shifting the movable components of the assembly between their sofa defining positions and bed defining positions, reasonably powerful electric motors must be used. However, because of the unique manner in which the shiftable components of the sofa bed assembly of the instant invention are supported from the main frame of the assembly and the motor driven drive structure is operatively connected thereto, relatively low power electric motors may be used.

The main object of this invention is to provide a convertible sofa bed assembly specifically designed for usage in a van-type motor vehicle.

Another object of this invention is to provide a convertible sofa bed assembly constructed in a manner whereby it may be readily converted between a sofa defining structure and a bed defining structure.

Yet another important object of this invention is to provide a convertible sofa bed assembly which may be converted between a sofa defining structure and a bed defining structure through the utilization of reversable electric motor powered drive structure.

A final object of this invention to be specifically enumerated herein is to provide a convertible sofa bed assembly in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

Brief Description of the Drawings

FIG. 3 is an enlarged vertical sectional view taken substantially upon the plane indicated by the section line 3—3 of FIG. 1;

FIG. 5 is an enlarged fragmentary vertical sectional view taken substantially upon the plane indicated by the section line 5—5 of FIG. 4;

DESCRIPTION OF THE PREFERRED EMBODIMENT

Figure 1:
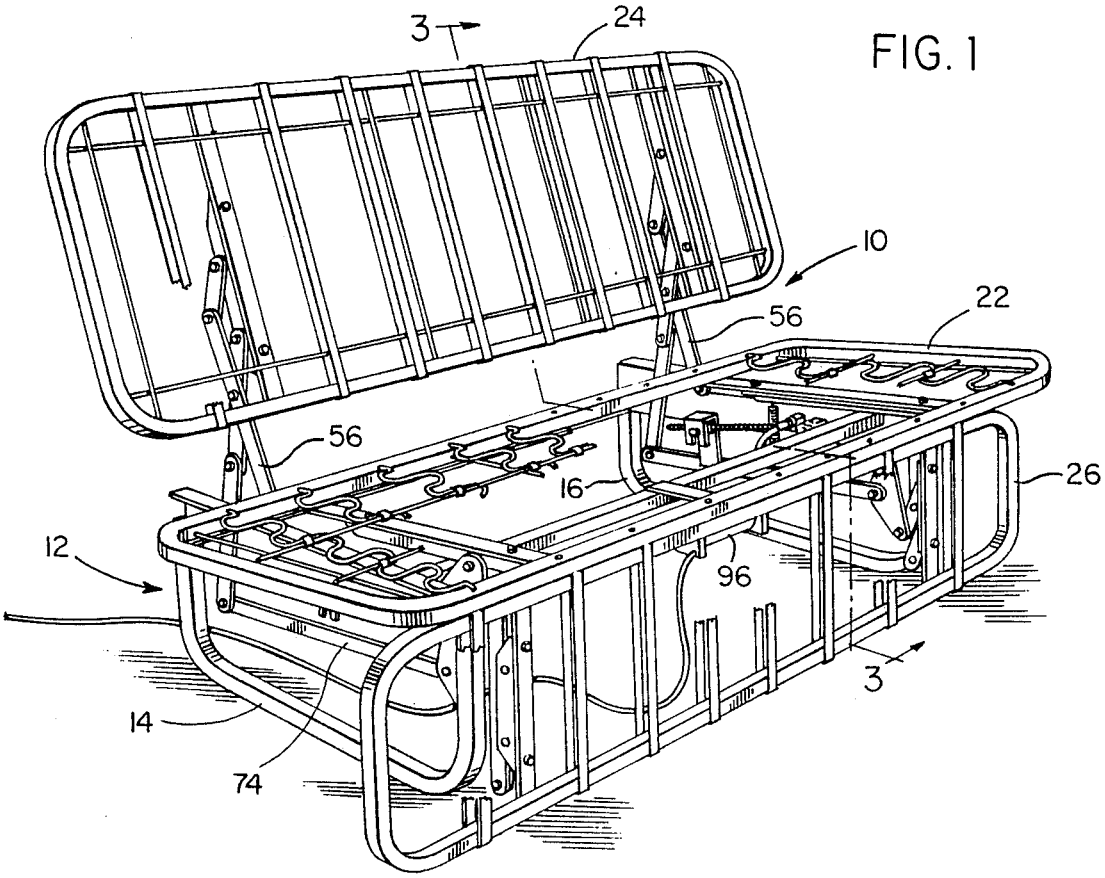
FIG. 1 is a perspective view of the convertible sofa bed assembly of the instant invention with the cushions thereof removed and the assembly in a sofa defining configuration.
Figure 2:
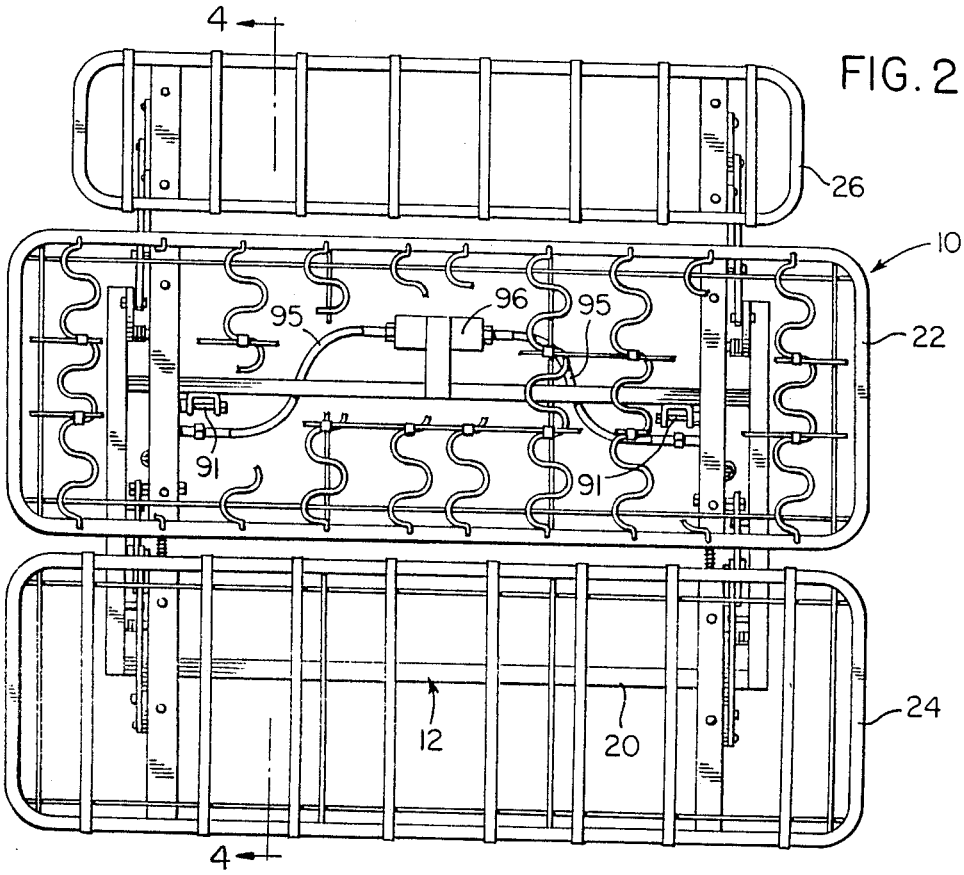
FIG. 2 is a top plan view of the sofa bed assembly with the assembly in a bed defining configuration.

Referring now more specifically to the drawings, the numeral 10 generally designates the sofa bed assembly of the instant invention. The assembly 10 includes a base frame referred to in general by the reference numeral 12 including upright opposite side frame sections 14 and 16 interconnected by front and rear transverse frame members 18 and 20. Also, the assembly 10 includes a forward seat support 22, a rear seat support 24 and a forward kick panel support 26.

Each upright frame section 14 and 16 includes pivot mounting locations or bores 28, 30, 32 and 34 as well as a pair of stop pins 36 and 38. Further, the opposite ends of the transverse frame member 18 each include a pair of apertured mounting lugs 40 which project rearwardly therefrom and each frame section 14 and 16 includes a depending support 42 provided with a downwardly opening notch as at 44.

A pair of front-to-rear extending opposite side angle members 46 are rigidly secured to the undersides of the opposite ends of the support 22 and the forward ends of the angle members 46 are pivotally supported from the corresponding frame sections 14 and 16 through pivot fasteners 48 secured through the bores 28. Further, a connecting link 50 has its longitudinal mid-portion pivotally supported from each support 14 and 16 by a pivot fastener 52 secured through the corresponding bore 32 and the front end of each connecting link 50 is pivotally attached to the rear of the corresponding angle member 46 by a pivot fastener 54.

A first lazy &:long linkage assembly 56 is pivotally connected between each frame section 14 and 16 and the corresponding end of the rear seat back support. Each link assembly 56 is pivotally supported from the corresponding end of the rear seat back support as at 58 and 60 and to the corresponding frame section 14, 16 by a fastener 62 secured through the corresponding bore 34 and the corresponding pivot fastener 52. The lazy tong linkage assembly 56 supports the rear seat back support 24 from the frame 12 for guided movement of the seat back support 24 between the seat back support defining position thereof illustrated in FIGS. 1 and 3 with the seat back support in a raised generally upright position extending upwardly from the rear of the base frame 12 and a lowered generally horizontal position such as that illustrated in FIG. 4. It will be noted from a comparison of FIGS. 3 and 4 of the drawings that the stop pin 38 defines not only the raised upright limit position of the seat back support 24 but also the lowered generally horizontal position thereof, the pin 38 being abuttingly engageable with portions of the lazy tong link assembly 56 in each of the raised and lowered limit positions of the rear seat back support 24.

Figure 4:
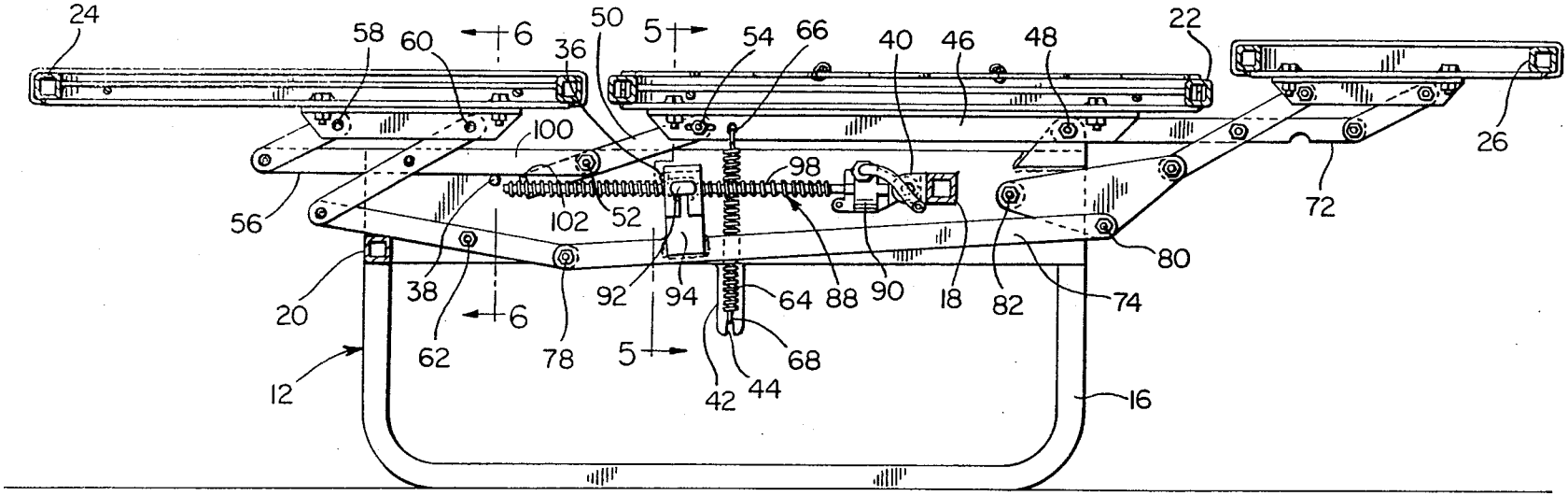
FIG. 4 is an enlarged vertical sectional view taken substantially upon the plane indicated by the section line 4—4 of FIG. 2.
Figure 7:
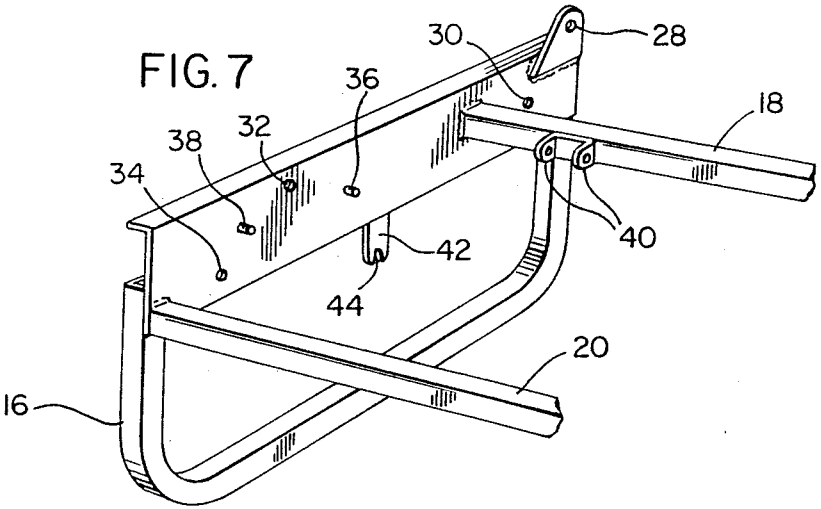
FIG. 7 is a fragmentary perspective view of the left side of the base frame of the sofa bed assembly as seen from a location rearwardly and above the right side of the base frame.
Figure 6:
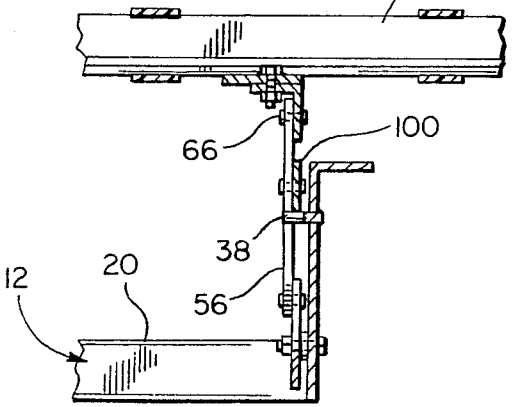
FIG. 6 is an enlarged fragmentary vertical sectional view taken substantially upon the plane indicated by the section line 6—6 of FIG. 4.

Furthermore, the connecting link 50 comprises a link connection between the lazy tong link assembly 56 and the links comprising the angle members 46 which support the forward seat support 22 from the frame 1 for movement between the bed defining horizontal position thereof illustrated in FIG. 4 and the slightly rearwardly and downwardly inclined position thereof when the sofa bed assembly 10 is in the sofa configuration.

A pair of expansion springs 64 are operably connected between the angle members 46 as at 66 and the lower notched ends of the supports 42 as at 68 and yieldingly bias the forward seat support 22 toward the rearwardly and downwardly inclined position thereof illustrated in FIG. 3.

The kick panel support 26 is supported from the frame 12 by a linkage assembly 72 for guided movement between the lowered upstanding position thereof illustrated in FIG. 3 and the raised horizontal position thereof illustrated in FIG. 4 spaced slightly forward of the seat support 22 when the seat support 22 is in the horizontal position thereof. In addition, a pair of opposite side connecting links 74 are pivotally connected between the link assemblies 56 as at 78 and the link assemblies 72 as at 80. In addition, the link assemblies 72 are pivotally supported from the frame 12 as at 48 and also by pivot fasteners 82 secured through bores 30.

It will be noted that in FIG. 4 the supports 22 and 24 are horizontally aligned. The supports 22 and 24 are designed to have relatively thick cushions supported therefrom. However, the kick panel support 26 is designed to have a relatively thin cushion supported therefrom. Therefore, the kick panel support 26 is slightly elevated relative to the supports 22 and 24 illustrated in FIG. 4 in order that the upper surface of a relatively thin cushion supported from the kick panel support 26 will be horizontally registered with the upper surfaces of thicker cushions supported from the supports 22 and 24.

A pair of reversable electric motor screw jack assemblies referred to in general by the reference numeral 88 have the gear housings 90 thereof pivotally supported from pivot bolts 91 secured through the corresponding mounting lugs 40 and the followers 92 thereof pivotally supported from upstanding supports 94 carried by the connecting links 74. The gear housings 90 are driven through flexible drive shafts 95 from a single reversible electric motor 96.

Assuming that the sofa bed assembly 10 is in the sofa defining configuration thereof illustrated in FIG. 3, the electric motor 96 is actuated whereby the followers 92 will move along the screw shafts 98 of the assemblies 88 toward the gear housings 90. This of course causes the connecting links 74 to shift to the right as viewed in FIG. 3 of the drawings and the seat back support 24 begins to be lowered toward the horizontal position thereof illustrated in FIG. 4 while the kick panel support 26 begins to be shifted to the raised horizontal position thereof illustrated in FIG. 4. Continued operation of the electric motor 96 functions to further lower and raise the supports 24 and 26, respectively, until they approach their fully lowered and raised positions, respectively. As the support 24 nears the fully lowered position thereof, the right hand ends of the links 100 of the link assemblies 56 engage the inturned integral flange portions 102 carried by the rear ends of the connecting links 50 and cause the rear ends of the connecting links 50 to be depressed and the forward ends thereof pivotally connected to the rear ends of the angle members 46 to be elevated, thereby raising the rear marginal portion of the seat support 2 to the horizontal position thereof illustrated in FIG. 4, the forward ends of the connecting links 50 being elevated out of abutting engagement with the stop pins 36. It also will be noted that the forward ends of the links 100 engage the stop pins 38 to define the lower limit position of the seat back support 24. From FIG. 3 of the drawings it may be seen that the links 104 of the link assemblies 56 also engage the pins 38 to define the upper limit position of the seat back support 24. Of course, as soon as the supports 22, 24 and 26 reach the bed defining positions thereof illustrated in FIG. 4, operation of the motor 96 is terminated.

Further, upon reverse operation of the motor 96, the supports 24 and 26 are raised and lowered, respectively, toward the raised and lowered positions, respectively, thereof illustrated in FIG. 3 and upon initial raising of the seat back support 24 the links 100 are raised slightly and the connecting links 50 are allowed to pivot about the pivot fasteners 52 to lower the forward ends of the connecting links 50 under the biasing action of the associated expansion springs 64 until the forward end portions of the connecting links 50 abut the stop pins 36. Thus, the seat support 22 is maintained in the slightly rearwardly and downwardly inclined position thereof illustrated in FIG. 3 except during those periods that the seat back support 24 makes its final movement to the lowered position thereof illustrated in FIG. 4 and makes its initial movement from the lowered position thereof illustrated in FIG. 4 toward the raised position thereof illustrated in FIG. 3.

It is also pointed out that any weight applying a downward pressure upon the seat back support 24 when the latter is in the horizontal position thereof illustrated in FIG. 4, functions to maintain the rear end of the seat support 22 in its elevated position. Also, any weight bearing down upon the rear of the seat support 22 when in the lowered position illustrated in FIG. 4 is ineffective to overcome even the weight of the empty rear seat back support 24 to elevate the latter, inasmuch as the lever arm between the pivot fasteners 52 and the flange portions 102 is extremely short.

The relatively thick cushions to be supported from the supports 22 and 24 have been omitted from the drawings for clarity purposes. In addition, the thinner cushion to be supported from the kick panel support 26 has been omitted for the same reason.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A convertable seat bed assembly including a base frame having front and rear sides, a forward seat support and a rear seat back support disposed rearward of said forward seat support, first linkage means connected between said base frame and said seat back support for guided movement of said seat back support between a raised seat back support defining position with said seat back support in a raised generally upright position extending upwardly from the rear side of said base frame and a lowered generally horizontal position projecting rearwardly of said base frame, second linkage means connected between said base frame and said forward seat support for guided movement of said forward seat support between a first generally horizontally position disposed closely forward of said rear seat back support when the latter is in the lowered position thereof and a second slightly rearwardly and downwardly inclined position with the rear extremity of said forward seat support lowered relative to the horizontal position of said forward seat support, force means operably connected between said base frame and said first linkage means for shifting said seat back support between the raised and lowered positions thereof, biasing means operatively connected between said base frame and said forward seat support yieldingly biasing said forward seat support toward said second position, and connecting means connected between said first and second linkage means and operatively associated with said base frame for shifting said forward seat support from said second position thereof to the first position thereof responsive to final movement of said seat back support from said raised position to said lowered position.

2. The assembly of claim 1 wherein the operative association between said base frame and connecting means includes a pivotal connection means fixed relative to said base frame and connecting lever means pivoted from said frame at said pivotal connecting means and engageable by said first linkage means during final movement of said seat back frame to the lowered position thereof, said connecting lever means being connected to said first linkage means.

3. The assembly of claim 2 wherein said first linkage means includes a pivot connection with said base frame at said pivotal connection means.

4. The assembly of claim 1 wherein said base frame includes abutment means engageable by the rear extremity of said forward seat support to define the limit of movement of said forward seat support to said second position thereof.

5. The assembly of claim 1 wherein said seat support includes a forward portion thereof pivotally supported from said base frame for angular displacement of said seat support between said first and second positions thereof about a horizontal transverse axis relative to said base frame.

6. The assembly of claim 1 wherein said base frame of said seat bed assembly includes opposite side frame portions, a forward transverse support frame member extending between and interconnecting forward portions of said opposite side frame portions, said force means including reversable electric motor driven screw jack means operatively connected between the opposite ends of said transverse frame member and said first linkage means.

7. The assembly of claim 1 including a kick panel support, third linkage means mounting said kick panel support from said base frame for guided movement between a lowered upstanding position extending across said front side of said base frame and a raised horizontal position disposed closely forward of said seat support when the latter is in said first position, and motion transmitting means operatively connected between said first and third linkage means operative to cause said kick panel support to move between said lowered and raised positions thereof responsive to movement of said seat support between said first and second positions, respectively, thereof.

8. The assembly of claim 7 wherein said first linkage means includes a pivot connection with said base frame at said pivotal connection means.

9. The assembly of claim 7 wherein wherein said base frame includes abutment means engageable by the rear extremity of said forward seat support to define the limit of movement of said forward seat support to said second position thereof.

10. The assembly of claim 7 wherein said seat support includes a forward portion thereof pivotally supported from said base frame for angular displacement of said seat support between said first and second positions thereof about a horizontal transverse axis relative to said base frame.

11. The assembly of claim 7 wherein said base frame of said seat bed assembly includes side frame portions, a forward transverse support frame member extending between and interconnecting forward portions of said opposite side frame portions, said force means including reversable electric motor driven screw jack means operatively connected between the opposite ends of said transverse support frame member and said first linkage means.

12. The assembly of claim 1 wherein said first linkage means includes an operative association with said seat back support, said force means and said connecting means such that gravity weighting of said seat back support is operative to lessen the working load on said force means as said seat back support is lowered toward a position immediately prior to said final movement toward said lowered position and functions, in conjunction with said connecting means, to counter act the biasing action of said biasing means during said final movement of said seat back support toward said lowered position.

13. The assembly of claim 12 wherein said operative association between said seat back support, said force means and said connecting means, through said biasing means, also functions to enable said biasing action of said biasing means to supplement said force means during initial movement of said seat back support from said lowered position toward said raised position.

* * * * *